United States Patent [19]

Macan et al.

[11] 4,189,255

[45] Feb. 19, 1980

[54] SEA-FLOOR SHORING CELLAR AND METHOD OF INSTALLING SAME

[75] Inventors: John J. Macan, Fulshear; James M. Magill, Houston, both of Tex.

[73] Assignee: Atwood Oceanics, Inc., Houston, Tex.

[21] Appl. No.: 919,752

[22] Filed: Jun. 28, 1978

[51] Int. Cl.[2] ..... E02D 5/60

[52] U.S. Cl. ..... 405/211; 405/195; 405/226

[58] Field of Search ..... 61/53.74, 41 R, 72.4, 61/99, 89, 98; 166/368

[56] References Cited

U.S. PATENT DOCUMENTS

| | | | |
|---|---|---|---|
| 428,021 | 5/1890 | Rothwell | 61/41 R |
| 1,905,643 | 4/1933 | Johnson | 61/53.74 X |
| 3,344,612 | 10/1967 | Rininger | 405/226 |
| 3,926,003 | 12/1975 | Norman | 61/72.4 |
| 3,965,687 | 6/1976 | Shaw | 61/53.74 |

FOREIGN PATENT DOCUMENTS

| | | | |
|---|---|---|---|
| 1429312 | 3/1976 | United Kingdom | 405/248 |

*Primary Examiner*—Dennis L. Taylor

*Attorney, Agent, or Firm*—Pravel, Gambrell, Hewitt, Kirk, Kimball & Dodge

[57] ABSTRACT

An implantable sea-floor shoring cellar is provided for housing drilling equipment such as a blowout preventer stack at least partly below the sea floor in order to allow oil well drilling by drill ships in shallow water areas where the distance between the sea floor and the drill ship is not sufficient to allow for normal positioning of the blowout preventer stack above the sea floor. The implantable sea-floor shoring cellar includes a substantially cylindrical retainer wall assembly with an annular air ejector assembly including ejector nozzles mounted within the retainer wall assembly adjacent to a lower opening; and a plurality of discharge tubes are mounted over the ejector nozzles for removing earth loosened from the sea floor during cutting of an opening below the retainer wall assembly so that the retainer wall assembly may be lowered without interference into place at least partly below the sea floor.

5 Claims, 7 Drawing Figures

SEA-FLOOR SHORING CELLAR AND METHOD OF INSTALLING SAME

DESCRIPTION

Technical Field

The field of this invention relates to shallow water drilling operations where floating drilling vessels such as drill ships cannot normally be utilized.

Background Art

In the past, it has been necessary to utilize jackup or submersible drilling units in shallow waters where the water depth was less than about 100 feet. Greater depths of water have been necessary for the utilization of drill ships in order to provide sufficient distance in the riser system from the drill floor to the ball joint of the blowout preventer stack to allow for horizontal movement of the drill ship from factors such as wind, waves and current. Such horizontal movement of the drill ship causes the riser system to tilt from vertical, pivoting about the ball joint. Although a ball joint is generally designed to allow for a riser tilt to an angle of about ten degrees, other stress factors have limited the maximum desired tilt to approximately five degrees. Whenever drill ships have attempted to be used in water depths of less than 100 feet, it has been found that the amount of tilt caused by wind, waves and current has been greater than the desired five degrees thereby possibly subjecting the entire riser system and blowout preventer stack to failure. The utilization of drilling ships in water depths of greater than 100 feet is workable simply because the horizontal offset at the water surface caused by the elements does not cause as great an angle of pivot or flex at the ball joint. As the water depth is decreased, the horizontal offset of the drill ship causes a greater pivoting or flexing of the riser system about the ball joint and thus a more critical problem.

One possible solution is disclosed in U.S. Pat. No. 3,344,612 wherein a shallow water caisson is disclosed for placement at least partly below the sea floor to house the blowout preventer stack, thereby increasing the distance between the blowout preventer stack and the floor of the drilling vessel to an allowable limit. The shallow water caisson shown in U.S. Pat. No. 3,344,612 includes a hollow, cylindrical housing having a tapered base with an annular fluid manifold and a central supply pipe for directly outwardly drilling fluid to form a hole into which the hollow housing may be lowered. During placement of the patented caisson, drilling fluid is pumped outwardly both of the annular fluid manifold and of a central jetting nozzle mounted on the bottom of the central supply pipe in order to loosen the soil of the sea floor. As the soil is loosened, the hollow housing and tapered base is worked into the sea floor until the desired depth is reached.

SUMMARY OF THE INVENTION

This invention relates to an implantable sea-floor shoring cellar adapted for placement at least partly in the floor of the ocean to house oil well flow control equipment such as a blowout preventer. The implantable sea-floor includes a substantially cylindrical retainer wall assembly having a hollow interior, an upper rim structure forming a top opening and a lower rim structure forming a bottom opening. An annular air ejector is mounted within the retainer wall assembly adjacent to the bottom opening. The annular air ejector has a plurality of nozzles mounted therein and directed approximately vertically upwardly for directing outwardly air under pressure. A plurality of discharge tubes are mounted within the retainer wall assembly. Each discharge tube includes an upper inlet portion extending outwardly of the retainer wall assembly and a bottom inlet portion positioned at least partly over an air nozzle so that air directed outwardly through the air nozzles flows substantially directly into the discharge tubes thereby creating a vacuum or suction for carrying water and loosened soil through the discharge tube outwardly of the retainer wall assembly. The soil is loosened by one or more initial cutting and soil loosening tools which are operable from a drill ship for loosening the soil below the retainer wall assembly so that, upon removal of the soil through the discharge tubes, a well-defined hole is formed to receive the retainer wall assembly.

In practicing the method of this invention of implanting the retainer wall assembly, the cylindrical retainer wall is positioned on the sea floor at the drilling site. An initial hole is drilled directly below the retainer wall assembly with the cuttings from the drilling being removed from the interior of the retainer wall assembly and from the initial hole. The initial hole is then enlarged utilizing a rotating air jet to loosen the soil and form a hole of a diameter at least equal to that of the retainer wall assembly, with the soil which is loosened being removed from the hole, as it is formed or just after formation, and from the interior of the retainer wall assembly. Finally, the retainer wall assembly is lowered into the substantially cleaned hole so that only a part of the retainer wall assembly extends above the sea floor in order to house the blowout preventer stack at least partly below the level of the sea floor thereby increasing the distance from the blowout preventer stack to the drilling floor of the drill ship to allow the drill ship to drill in shallower waters.

DESCRIPTION OF THE PREFERRED EMBODIMENT

Figure 3:
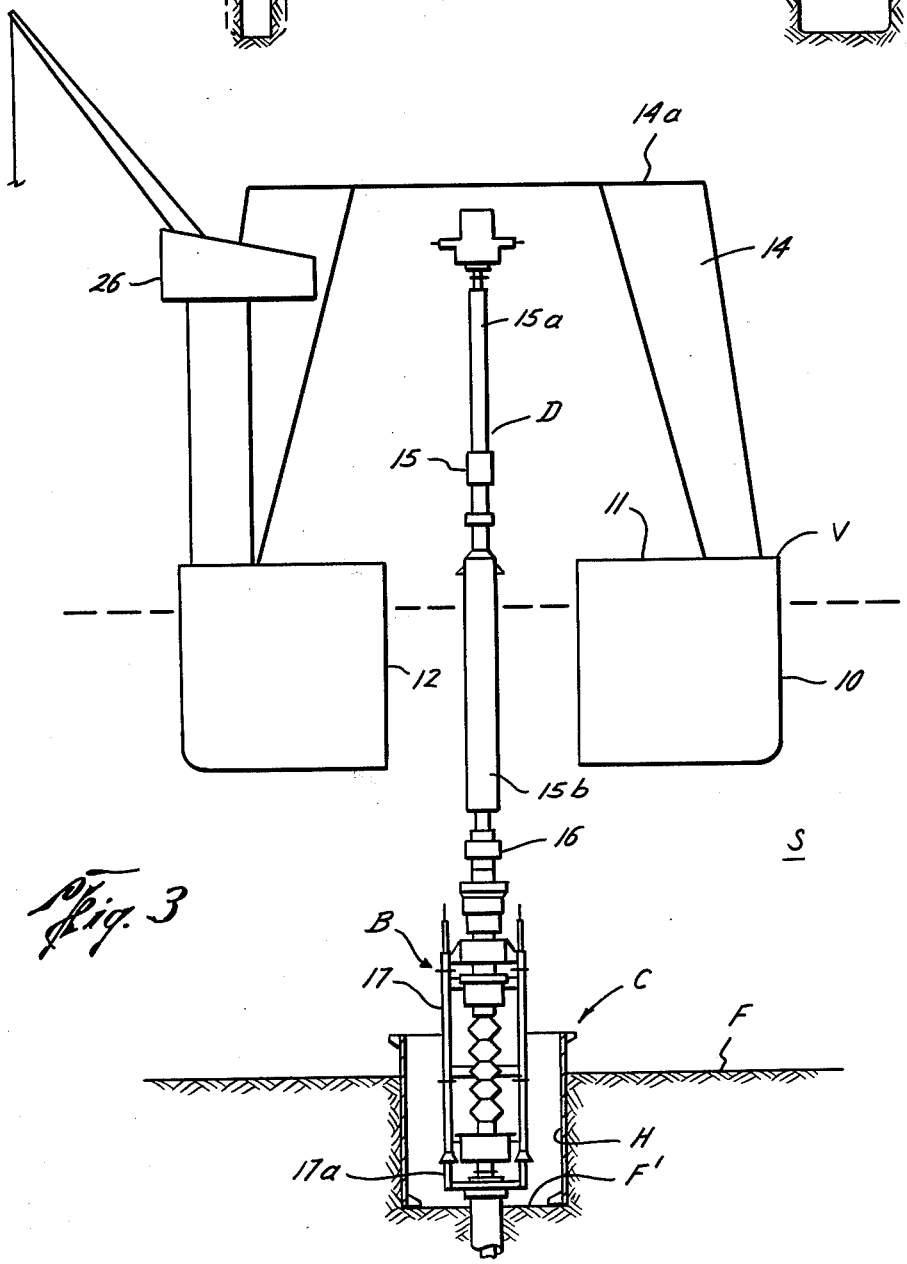
FIG. 3 illustrates the sea-floor shoring apparatus of this invention in position for housing at least part of a blowout preventer stack in order to allow a drill ship to perform drilling operations in shallow water.

Referring to the drawings and in particular to FIG. 3, the implantable sea-floor shoring cellar C of the preferred embodiment of this invention is illustrated in place in a hole H in the floor or bottom F of a body of water such as an ocean or sea S. The sea-floor shoring cellar C of this invention is implanted at least partly in the floor F of the sea S in order to house oil well equipment such as the blowout preventer stack B which provides emergency flow control for the drill string generally designated as D which extends upwardly to the drill ship V floating on the surface of the sea S. The vessel V may be a drill ship as illustrated in FIG. 3, a drill barge or other floating drilling vessel which is not normally fully supported on the sea floor F.

The drill ship V is only illustrated schematically in FIG. 3; but, as shown, the drill ship V includes a hull 10 and main deck 11. The hull of the drill ship 10 forms a drill opening 12 through which the drill string D extends. A drilling support structure generally designated as 14 is mounted on the vessel floor 11 and terminates in a drilling deck or floor 14*a* for supporting the rotary table and the usual supporting apparatus necessary to support the drill string D. Typically, and in FIG. 3, the drill string D includes a drill string slip joint 15 including inner barrel 15*a* connected at the rotary table and outer barrel 15*b* which is mounted onto ball joint 16 located at the top of the blowout preventer stack B. A riser pipe may be connected between housing 15*b* and ball joint 16. The drill string slip joint barrels 15*a* and 15*b* telescope in response to the vertical movement of the drill ship V. The blowout preventer stack B is typically a series of vertically stacked or interconnected valves supported on a guide post structure generally designated as 17. As is well known in the art, the valves such as blowout preventer valves, are designed to either close automatically or close by manual actuation (through remote control) in response to emergency conditions such as damage to the vessel or the upper structure of the drill string or to pressure surges within the well.

The forces of wind, waves and currents acting against the drill ship causes not only vertical movement but also horizontal movement. The vertical movement is compensated for through the drill string slip joint 15 just described. However, the entire drill string D is subjected to horizontal movement to the extent that such movement is not dampened by vessel anchoring. The amount of horizontal movement of the drill ship V is critical since the drill ship is connected through the drill string to the blowout preventer stack B. The ball joint valve 16 mounted at the top of the blowout preventer stack allows some tilting or pivoting of the drill string D in response to horizontal movement of the drill ship V. Although many ball joints 16 are designed to allow tilting of the slip joint 15 of about ten degrees, it has been found desirable to limit the tilting to about five degrees. Since the amount of allowable offset or horizontal deviation of the drill ship V which causes such tilting of the slip joint 15 is a function of depth, the amount of allowable horizontal offset of the drill ship V diminishes as the distance from the drilling deck 14*a* to the sea floor F diminishes. Generally speaking, it has been found that drill ships V cannot function fully safely in water depths (distance from the surface of the sea S to the sea floor F) or less than about 100 feet.

The sea-floor shoring cellar C of this invention is adapted for placement in the sea floor F in order to increase the distance between the top of the blowout preventer stack B and the surface of the sea, the vessel floor 11 and the drilling deck 14. The sea-floor shoring apparatus C of this invention actually lowers the position of the sea floor to F' for the purpose of oil well drilling, thereby increasing the effective distance between the sea floor F' and the drilling deck 14*a* in order to allow floating drilling vessels such as the drill ship V to be used in shallower waters.

Figure 5:
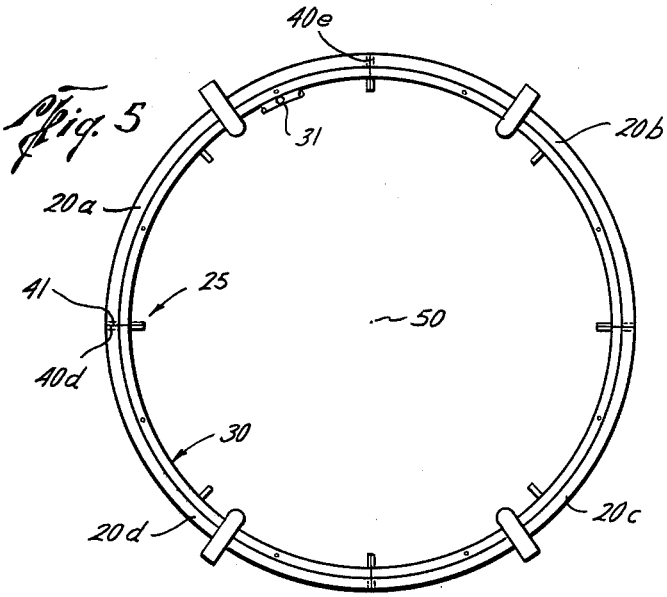
FIG. 5 is a top view of the sea-floor shoring apparatus of FIG. 4.
Figure 6:
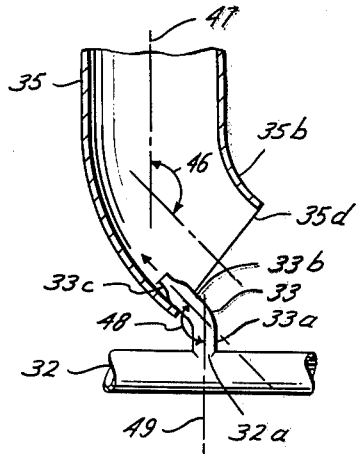
FIG. 6 is an enlarged view of a portion of the air lift system illustrating the structural relationship and positioning of the air lift nozzles and the discharge tubing.
Figure 4:
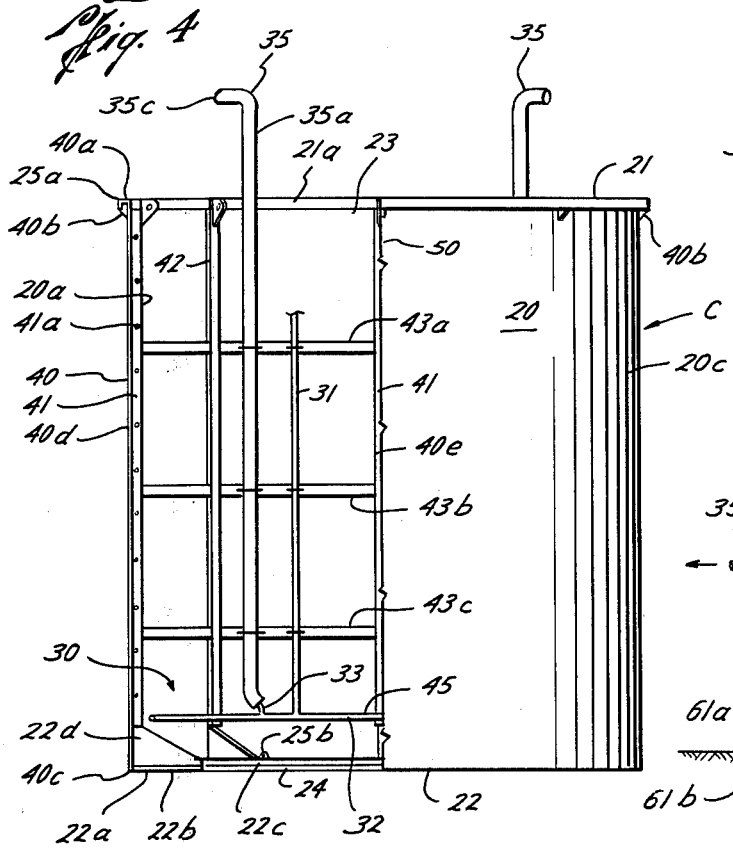
FIG. 4 is a side view partly in section of the sea-floor shoring apparatus of this invention.

Referring now to FIGS. 4–6, the sea-floor shoring cellar C of the preferred embodiment of this invention includes a substantially cylindrical retainer wall assembly generally designated as 20. The substantially cylindrical retainer wall assembly 20 is hollow and includes an upper rim structure 21 and a lower rim structure 22. The upper rim structure 21 provides a top opening 23 and the lower rim structure 22 provides a bottom opening 24 of lesser diameter.

Attachment means generally designated as 25 is mounted with the upper rim structure 21 for attaching the retainer wall assembly 20 to a suitable crane 26 or other hoist equipment for lowering the sea-floor shoring apparatus C to the sea floor F.

An annular air lift system 30 is mounted within the retainer wall assembly 20 adjacent to the lower rim structure 22. The annular air lift system 30 includes connector means 31 for connecting the air lift system to a source of air under pressure. The annular air lift system 30 further includes a tubular air ring 32 having a plurality of nozzles 33 which are directed generally vertically upwardly for ejecting air. A plurality of discharge tubes 35 are mounted substantially within the retainer wall assembly 20 for receiving air flowing outwardly of the nozzles 33 and for directing outwardly of the retainer wall assembly ejected air, water and solids carried therewith in response to the suction created at the entry point of each nozzle 33 into each discharge tube 35.

The retainer wall assembly 20 includes four sections 20*a*, 20*b*, 20*c* and 20*d*. Each of the four sections 20*a–d* comprise one-fourth of the total retainer wall assembly 20. The sections 20*a*–20*d* are identical in structure and therefore only the details of section 20*a* as illustrated in FIG. 4 will be described.

The retainer wall section 20*a* illustrated in detail in FIG. 4 includes an outer arcuate wall member 40 which extends through an arc segment of 90°. The upper rim structure 21 of the retainer wall asssembly 20 includes upper rim structure segment 21*a*, which is basically a L-shaped, arcuate flange member mounted onto the top edge 40*a* of the arcuate wall member 40 and supported in that position by circumferentially spaced gussets 40*b*. The bottom rim structure 22 includes an arcuate rim section 22*a* formed by a flat, arcuate plate 22*b* which is welded or otherwise attached onto bottom edge 40*c* of the wall member 40. The plate 22*b* terminates in an internal flange 22*c*; and, a plurality of gussets 22*d* are attached to the bottom portion of the outer wall member 40 and to the bottom plate 22*a* in order to assist in supporting the complete structure. The outer wall member 40 terminates in side edges 40*d* and 40*e*. Both side members 40*d* and 40*e* have welded or otherwise attached thereto vertically extending square connector tubes 41 which are mounted inside of the outer wall member 40 and extend upwardly from the bottom gussets 22*d* to the top edge 40*a* of the outer wall member 40. A number of bolt holes 41*a* are machined in the vertical connector tubes 41 for mating with similar connector tubes 41 on another retainer wall section such as 20*d*. In this manner, each of the four sections 20*a*–20*d* of the retainer wall assembly 20 are connected together to form the cylindrical wall assembly. Additional vertically extending bracing tubes such as 42 may be mounted at circumferentially spaced intervals along the inside wall of the retainer wall member 40 between the connector tubes 41.

The attachment means generally designated as 25 include a plurality of connector eyes 25*a* welded onto the top portion of the vertical connector and bracing tubes 41 and 42 for attachment to hoist lines connected to the crane 26. A plurality of horizontal stiffeners 43*a*, 43*b* and 43*c* are mounted onto the inside of the wall member 40 and extend between the vertical bracing members 41 and 42 to cooperate therewith to support the complete retainer wall member 40.

The air ring 32 of the air lift system 30 is an annular, hollow tube mounted within the interior of the joined retainer wall assembly 20 near the bottom opening 24. The air ring 32 may be held in position by brackets or welding or other suitable means. The means 31 for connecting the air ring 32 to a suitable source of air pressure is a supply line which is attached by a suitable coupling or other means to the air ring 32 and extends vertically upwardly on the horizontal braces 43*a–c* to a source of pressurized air mounted on the drill ship V.

The plurality of nozzles 33 are mounted in openings 32*a* in the air ring 32 by welding. Each nozzle 33 includes a vertical section 33*a* and an inclined or bent section 33*b* which is integrally connected with the vertical section 33*a* but is bent or angled from the vertical. The angled nozzle section 33*b* terminates in a section or tip 33*c* of reduced area.

A discharge tube 35 is provided for each nozzle 33. Each discharge tube 35 includes a central portion 35*a*, a bottom inlet portion 35*b* and an upper exit portion 35*c*, integrally connected together to form the complete discharge tube. Each discharge tube 35 is mounted within the assembled retainer wall assembly 20 with its central portion 35*a* being clamped or otherwise connected to one or more of the horizontal stiffeners 43*a–c*. The discharge tube inlet portion 35*b* is actually a bent or curved end section which is bent to an angle 46 equal to the angle 48 of bend of the nozzle section 33*b*. For the purposes of definition, the bent lower end portion 35*b* of the discharge tube is bent to an angle 46 with respect to the vertically oriented axis 47 of the main discharge tube portion 35*a*. The bent section 33*b* of nozzle 33 is bent at an angle 48 with respect to the vertical axis line 49 of vertical nozzle section 33*a*. The angles 46 and 48 are substantially equal. The nozzle outlet portion 35*c* is a bent end portion integrally connected to the central discharge tube portion 35*a* at the top thereof to extend radially outwardly with respect to the axis line 50 of the retainer wall assembly.

The delivery of air under pressure through supply line 31 into the air ring 32 causes the ejection of air outwardly of the nozzles 33 into the bent end portion 35*b* of the discharge tube 35. Air flow into the discharge tube 35 causes or creates a suction in opening 35*d* of the discharge tube 35 thereby causing water and solids contained in the water near opening 35*d* to flow into the discharge tube 35 and thus outwardly of outlet 35*c* of the retainer wall assembly 20.

Figure 1:
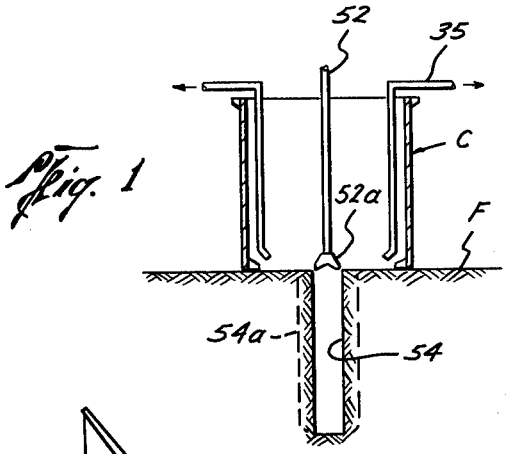
FIG. 1 is a schematic view of one of the steps of practicing the method of this invention of forming an initial hole below the sea floor below the sea-floor cellar apparatus of this invention.
Figure 2:
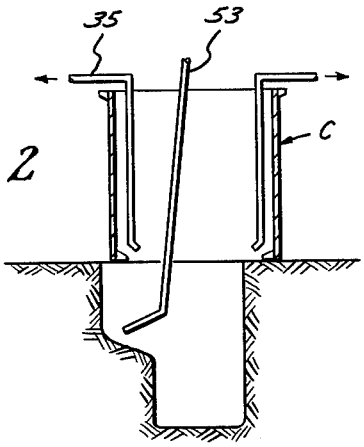
FIG. 2 illustrates the method and apparatus for enlarging the initial hole of FIG. 1 to sufficient size to allow the sea-floor apparatus to be lowered therein.
Figure 7:
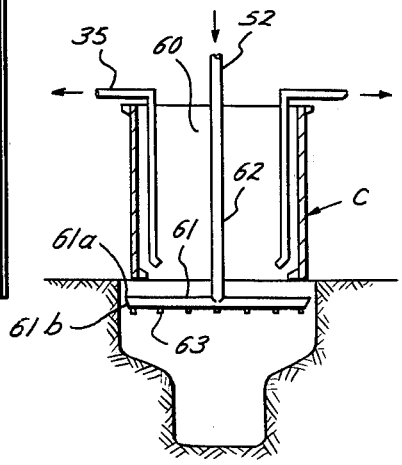
FIG. 7 illustrates another apparatus for forming the hole in the sea floor to receive the sea-floor cellar apparatus of this invention.

The sea-floor shoring apparatus C of this invention further includes various means for digging the hole H. Referring to FIG. 1, a drilling string 52 is illustrated schematically. The drill string 52 includes a fish-tail bit 52*a* which is operated from the drill ship V for forming an initial hole 54 positioned below the central axis 50 of the retainer wall assembly 20. The initial hole 54 may be widened to the hole size at 54*a* by angling the fish-tail bit in hole 54. Referring to FIG. 2, a jetting tool 53 is illustrated schematically. The jetting tool 53 is attachable to the drill string for operation from the drill ship V. Compressed air or other gas or drilling fluid is directed through jetting tool 53 to enlarge the hole 54*a* to the size of the hole H for actually receiving the sea-floor cellar C. Referring to FIG. 7, a T-bar jetting tool 60 is illustrated. The jetting tool 60 includes a horizontal section 61 and a vertical section 62, the horizontal section having a plurality of exit nozzles 63 mounted on the underside and directed vertically downwardly. Each end of the horizontal section or bar 61 terminates in an inclined portion 61*a* having a nozzle 61*b* mounted therein for directing fluid partly with a radial vector. The vertical section 62 is adapted for connection to the drill string 52.

The method of this invention for positioning a blowout preventer stack B at least partly below a sea-floor F in order to allow drilling in shallow water areas by a floating drill ship V is practiced as follows. The four sections 20*a–d* of the retainer wall assembly are interconnected on the drill ship V. The air lift system generally designated as 30 including the air ring or header 32 and supply line 31 is mounted inside of the retainer wall assembly 20 and the discharge tubes 35 are positioned in place such that the bottom, bent end portion 35*b* of each discharge tube 35 is positioned over the angled nozzle end portion 33*b* of each nozzle mounted on air ring 32. The crane 26 is then attached to the retainer wall assembly 20 through connecting eyes 25*a*. The entire sea-floor shoring cellar C is then lowered into the water to the sea floor such that the cellar C is centrally located over the drill site. The drill ship V is then moved sideways until the drill well or opening 12 of the vessel is positioned directly over the sea-floor cellar C. The connector eyes 25*a* are then connected to lift lines on the travelling block hoist or other crane positioned over the drill well 12 (not shown) and the sea-floor shoring apparatus C is raised into the drill ship well for connecting additional guide lines to the lower guide eyes 25*b* welded on bottom gussets 22*d*. An air supply is connected to line 31 mounted within the retainer wall assembly 20. The hoist lines of the travelling block as connected to the pad eyes 25*a* and guide eyes 25*b* guide the sea-floor cellar C downwardly into position on the sea-floor F centered over the drill site. The lines connected to guide eyes 25*b* cooperate to later function as guide means to guide the permanent guide base 17*a* for the blowout preventer stack B into position.

A drill string 52 having fish-tail bit 52*a* mounted thereon is directed downwardly into the flooring in order to cut an initial hole 54 below the center of the sea-floor cellar C. The drill ship V and the fish-tail drill string 52 is then maneuvered to enlarge that hole somewhat to 54*a*. The jetting tool 53 is then mounted on the drill string and lowered into the enlarged hole 54*a* and rotated therein to gradually enlarge the hole 54*a* to a diameter at least equal to the diameter of the retainer wall assembly 20 of the sea-floor shoring cellar C. During the cutting by the fish-tail bit 52*a* and during the soil loosening by the jetting tool 53, the cuttings and loosened soil is removed due to the suction action of the air injected into the discharge tubes 35 through nozzles 33. In this manner, the loosened soil is removed simultaneously with the loosening thereof so that the soil does not settle back into the hole H being formed. The T-bar jetting tool 60 may be used instead of the fish-tail bit 52*a* and the jetting tool 53. The T-bar jetting tool 60 is lowered on the drill string 52 to a position above the sea floor with the sea-floor shoring apparatus C resting on the sea floor. The drill string 52 is then rotated and gradually lowered as drilling fluid is pumped through the drill string and outwardly of nozzles 63 and 61*b* until the hole H is formed.

After the hole H is enlarged to its desired size as depicted in FIG. 3, the sea-floor cellar C is lowered into the hole and is seated on the bottom F′ thereof to thus create a new sea-floor F′ for drilling purposes. The annular lower plate 22*a* serves to help seat the unit C in an upright position. The guide base 17*a* is then lowered in position on guide lines extending to the bottom guide eyes 25*b* and the blowout preventer stack B is built on top of the base guide posts 17*a* in a known manner. In this manner, the ball joint 16 located at the top of the blowout preventer stack B is located a substantially greater distance from the surface of the sea S and thus from the drilling deck 14*a* than normal thereby increasing the effective distance between the drill ship V and to the altered sea-floor. In this manner, and due to the increase in distance between the ball joint 16 and the drilling apparatus mounted on the drill ship V, the effect of horizontal offset of the drill ship V is diluted as to its effect upon flexing or pivoting of the drill string D thereby allowing the drill ship V to be utilized in shallower waters than normally possible.

The method of this invention is designed to be used both in hard and soft sea floors. Other advantages of the sea-floor cellar C which houses the blowout preventer stack B, is to remove cuttings and other matter which may settle near the blowout preventer stack during drilling operations. The sea-floor cellar C of this invention may also be utilized in situations where obstacles such as ice flows would otherwise possibly damage a blowout preventer stack rising from the sea-floor F.

The foregoing disclosure and description of the invention are illustrative and explanatory thereof, and various changes in the size, shape and materials as well as in the details of the illustrated construction may be made without departing from the spirit of the invention. Although air has been described as the ejection other compressible fluids may also be used.

We claim:

1. An implantable sea-floor shoring cellar, which is adapted for placement at least partly in the floor of the ocean to house oil well flow control equipment such as a blowout preventer stack, comprising:

a substantially cylindrical retainer wall assembly having a hollow interior, said retainer wall assembly having an upper rim structure forming a top opening and a lower rim structure forming a bottom opening;

attachment means mounted with said upper rim structure for attaching said retainer wall assembly to a suitable crane for lowering said sea-floor shoring cellar to the sea-floor from a drilling vessel;

an annular air ejector mounted within said retainer wall assembly adjacent to said lower rim structure, said annular air ejector including means for connecting said air ejector to a source of air under pressure, said annular air ejector including a tubular air ring having mounted therewith a plurality of air nozzles directed generally vertically upwardly; and a plurality of discharge tubes, each discharge tube being mounted substantially within the interior of said retainer wall assembly and including an upper outlet portion extending outwardly of said retainer wall assembly and an inlet portion positioned at least partly over one of said nozzles for directing air, water and solids through said discharge line upwardly and outwardly of the interior of said retainer wall assembly.

2. The structure set forth in claim 1, including:

said retainer wall assembly being formed by a plurality of interconnected sections, each section including an arcuate outer wall portion having a portion of each of said upper and lower rim structure and further including side connectors for connecting said sections together.

3. The structure set forth in claim 1, including:

said lower inlet portion of each of said discharge tubes is bent; and each of said nozzles on said annular ring includes a section which is bent and positioned inside of said bent lower inlet portion of said discharge tube.

4. The structure set forth in claim 1, including:

a cutting tool for cutting an initial hole into the sea-floor at approximately the center of the retainer wall assembly; and a rotatable jetting tool for positioning in said initial hole for enlarging the initial hole to the diameter of the retainer wall assembly.

5. A method of positioning a blowout preventer stack at least partly below a sea-floor in order to allow drilling in shallow water areas where the distance between the sea-floor and a drill ship is not sufficient to allow for normal positioning of the blowout preventer stack above the sea floor, comprising the steps of:

positioning a cylindrical retainer wall assembly on the sea floor at a drilling site;

drilling an initial hole directly below the retainer wall assembly and removing cuttings from the interior of the cylinder wall container by suction action;

enlarging the initial hole utilizing a rotating air jet to loosen the soil and simultaneously remove the loosened soil from the interior of the retainer wall assembly until a hole at least as large as the retainer wall assembly is cleared; and lowering the retainer wall assembly into the hole so that only a part of the retainer wall assembly extends above the sea floor.

* * * * *

UNITED STATES PATENT AND TRADEMARK OFFICE

CERTIFICATE OF CORRECTION

PATENT NO. : 4,189,255

DATED : February 19, 1980

INVENTOR(S) : John J. Macan and James M. Magill

It is certified that error appears in the above-identified patent and that said Letters Patent are hereby corrected as shown below:

Column 2, line 5, delete "inlet" and insert --outlet--.

Signed and Sealed this

*Twenty-seventh* Day of *May 1980*

[SEAL]

*Attest:*

SIDNEY A. DIAMOND

*Attesting Officer*

*Commissioner of Patents and Trademarks*